US008262960B2

(12) United States Patent
Kimura et al.

(10) Patent No.: US 8,262,960 B2
(45) Date of Patent: Sep. 11, 2012

(54) COMPRESSION-MOLDED PRODUCT USING PLANT MATERIAL AND METHOD FOR MANUFACTURING THE SAME

(75) Inventors: Koichi Kimura, Kawasaki (JP); Takamitsu Nakamura, Saga (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/621,971

(22) Filed: Nov. 19, 2009

(65) Prior Publication Data

US 2010/0062248 A1 Mar. 11, 2010

Related U.S. Application Data

(63) Continuation of application No. PCT/JP2007/060990, filed on May 30, 2007.

(51) Int. Cl.
*B27N 3/08* (2006.01)

(52) U.S. Cl. ..... 264/120; 264/124

(58) Field of Classification Search ..... None
See application file for complete search history.

(56) References Cited

U.S. PATENT DOCUMENTS

| | | | | |
|---|---|---|---|---|
| 726,029 | A * | 4/1903 | Classen | 106/165.01 |
| 2,388,487 | A * | 11/1945 | Linzell | 162/181.3 |
| 2,779,683 | A * | 1/1957 | Gill, Jr. | 106/164.5 |
| 3,686,384 | A * | 8/1972 | Runton | 264/122 |
| 4,056,342 | A | 11/1977 | Fremont et al. | |
| 5,017,319 | A | 5/1991 | Shen | |
| 5,093,051 | A * | 3/1992 | Reiniger | 264/29.4 |
| 5,688,448 | A * | 11/1997 | Shutov et al. | 264/54 |
| 5,855,832 | A * | 1/1999 | Clausi | 264/109 |
| 6,512,174 | B2 | 1/2003 | Mori et al. | |
| 6,791,029 | B2 | 9/2004 | Mori et al. | |
| 7,183,339 | B2 * | 2/2007 | Shen et al. | 524/13 |
| 2006/0091577 | A1 | 5/2006 | Shen et al. | |

(Continued)

FOREIGN PATENT DOCUMENTS

CN 1105310 A 7/1995

(Continued)

OTHER PUBLICATIONS

International Search Report of PCT/JP2007/060990, mailing date of Aug. 21, 2007.

(Continued)

*Primary Examiner* — Mary F Theisen
(74) *Attorney, Agent, or Firm* — Westerman, Hattori, Daniels & Adrian, LLP

(57) ABSTRACT

First, wood or bamboo is crushed to obtain wood powder with an average grain size of 5 μm to 100 μm. Next, the wood powder is put in a first mold, and a first compression molding step is carried out under the conditions that, for example, a temperature is 160° C. and a pressure is 30 MPa. Thus, a temporary molded body is obtained. Subsequently, the temporary molded body is immersed in a flame retardant and a surface of the temporary molded body is impregnated with the flame retardant. Thereafter, the temporary molded body is put in a second mold, and a second compression molding step is carried out under the conditions that, for example, a temperature is 200° C. and a pressure is 100 MPa. At this time, ingredients such as lignin and a hemicellulose are separated from the wood powder, and function as an adhesive. For this reason, pieces of crushed material are firmly bonded with each other so as to be integrated into a single body. Thus, a compression-molded product with a predetermined shape is obtained.

5 Claims, 5 Drawing Sheets

U.S. PATENT DOCUMENTS

| | | | |
|---|---|---|---|
| 2007/0000146 | A1 | 1/2007 | Boonstra et al. |

FOREIGN PATENT DOCUMENTS

| | | | |
|---|---|---|---|
| EP | 0 161 766 | A1 | 11/1985 |
| EP | 0 573 695 | A1 | 12/1993 |
| JP | 2580522 | B2 | 2/1997 |
| JP | 2888153 | B2 | 5/1999 |
| JP | 2001-244645 | A | 9/2001 |
| JP | 2003-011109 | A | 1/2003 |
| JP | 2004-261967 | A | 9/2004 |
| JP | 2006-182994 | A | 7/2006 |
| JP | 2007-008000 | A | 1/2007 |
| WO | 94/26487 | A1 | 11/1994 |
| WO | 03/000475 | A1 | 1/2003 |
| WO | 2004/073944 | A1 | 9/2004 |

OTHER PUBLICATIONS

Chinese Office Action dated Nov. 30, 2010, issued in corresponding Chinese Patent Application No. 200780053168.7.

Supplementary European Search Report dated May 19, 2011, issued in corresponding European Patent Application No. 07744403.2.

Extended European Search Report dated Apr. 5, 2012, issued in corresponding Application 11194811.3.

* cited by examiner

COMPRESSION-MOLDED PRODUCT USING PLANT MATERIAL AND METHOD FOR MANUFACTURING THE SAME

CROSS-REFERENCE TO RELATED APPLICATIONS

This application is a continuation of the prior International Patent Application No. PCT/JP2007/060990, filed May 30, 2007, the entire contents of which are incorporated herein by reference.

FIELD

The embodiments discussed herein relate to a compression-molded product using, as a main raw material, a crushed material of a plant such as wood or bamboo and a method for manufacturing the same. More particularly, it relates to a compression-molded product suitable for a housing of an electronic device and a method for manufacturing the same.

BACKGROUND

In recent years, there have been concerns about exhaustion of fossil resources typified by petroleum, with mass consumption of the fossil resources. In addition, it is pointed out that global warming is caused by a large amount of carbon dioxide generated with the mass consumption of the fossil resources. Currently, petroleum-based resins are used for a variety of products. In view of the above concerns, however, there is a world-wide boom in using plant-based resins such as polylactic acid-based resins in place of petroleum-based resins.

Polylactic acid is made from a plant such as corn, and is decomposed into water and carbon dioxide by microorganisms in the ground after disposal. In addition, water and carbon dioxide are generated when polylactic acid is incinerated. The carbon dioxide thus generated is absorbed into a plant by photosynthesis, and is used for growth of the plant. In this way, plant-based resins such as polylactic acid-based resins are eco-friendly and recycling materials.

In recent years, a proposal has been made to use plant-based resins such as polylactic acid-based resins for a housing of an electronic device such as a notebook personal computer (PC) and a mobile phone (for example, Japanese Laid-open Patent Publication No. 2001-244645). Although having high rigidity such as bending strength, plant-based resins such as polylactic acid-based resins generally have insufficient impact resistance such as Izod impact strength, and have low heat resistance such as heat deflection temperature. For this reason, it is difficult to use a housing of an electronic device by using a plant-based resin alone. To address this issue, a study has been conducted to form a housing of an electronic device by using a resin made of a mixture of plant-based and petroleum-based resins (for example, Japanese Laid-open Patent Publication No. 2006-182994).

Additionally, as a member using a plant material, there is known a wooden board (also referred to as a particle board) (for example, Japanese Patent No. 2888153 and Japanese Patent No. 2580522). The wooden board is a board obtained in such a manner that crushed lumber, thin paper-like lumber, waste paper or the like (hereinafter referred to as a "fractured material or the like") are impregnated with an adhesive (a binder), and then are compressed and laminated with each other. The wooden board has characteristics of being relatively hard and rigid. However, a petroleum-based adhesive or solvent is used for the wooden board, and constitutes more than 30% of the wooden board in some cases. In addition, the wooden board is unsuitable for precision processing because a fractured material or the like as a raw material has a great variation in size. Moreover, flame retardancy as specified in UL standards is required for a housing of an electronic device such as a notebook personal computer. For this reason, it is difficult to use a wooden board as it is for a housing of an electronic device.

SUMMARY

According to an aspect of the embodiments, a compression-molded product includes: a crushed plant material; and an adhesive ingredient separated from the crushed plant material.

In addition, according to another aspect of the embodiments, a method for manufacturing a compression-molded product includes: obtaining a crushed plant material by crushing a plant; and separating an adhesive ingredient derived from the crushed plant material by pressuring on heating the crushed plant material as a pressure molding.

Moreover, according to another aspect of the embodiments, a method for manufacturing a compression-molded product includes: obtaining a crushed plant material by crushing a plant; forming a temporary molded body by pressurizing the crushed plant material as a first pressure molding; and separating an adhesive ingredient derived from the crushed plant material by pressuring on heating the temporary molded body as a second pressure molding.

The object and advantages of the embodiments will be realized and attained by means of the elements and combinations particularly pointed out in the claims.

It is to be understood that both the foregoing general description and the following detailed description are exemplary and explanatory and are not restrictive of the embodiments, as claimed.

DESCRIPTION OF EMBODIMENTS

As described above, conventionally, manufacturing a molded product with high strength and high processing accuracy is difficult by using only a plant material, and therefore requires a lot of petroleum-based resins when a plant material is used. Accordingly, there has been a demand for a molded product using no or little petroleum-based resins and a manufacturing method thereof.

Hereinafter, preferred embodiments will be described with reference to the accompanying drawings.

(First Embodiment)

Figure 1:
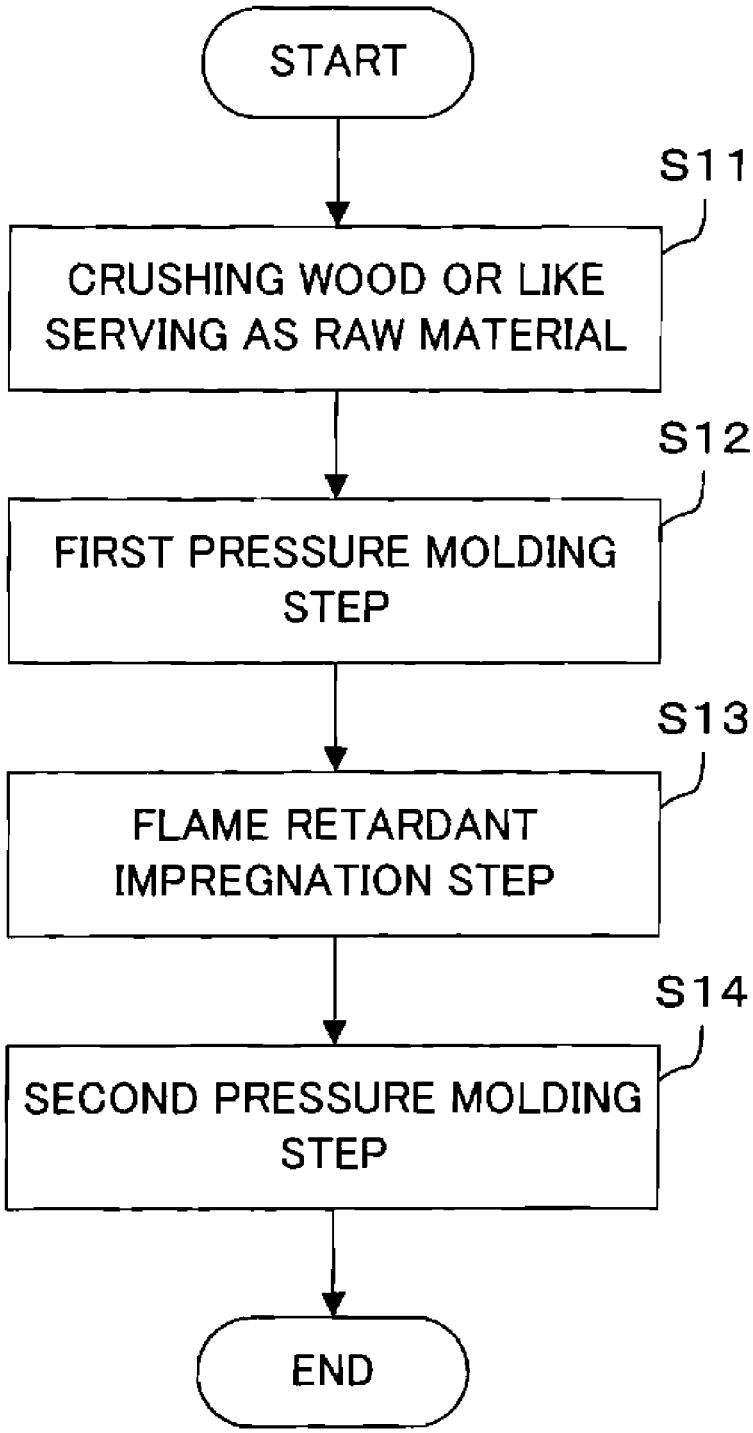
FIG. 1 is a flowchart depicting a method for manufacturing a compression-molded product according to a first embodiment.

FIG. 1 is a flowchart depicting a method for manufacturing a compression-molded product according to a first embodiment, and FIGS. 2A to 2D are schematic views depicting, in the order of steps, the method for manufacturing the same.

First, as a raw material, wood or bamboo (hereinafter, referred to as "lumber or the like") is crushed to obtain a crushed material with a grain size (an average grain size) of, for example, 5 μm to 100 μm (hereinafter, also referred to as "wood powder") (Step S11). A kind of wood or bamboo serving as a raw material is not particularly limited. Here, usable ones are, for example, heartwoods and skins of a Japanese cedar (Sugi), a Japanese cypress (Hinoki), a beech (Buna), a paulownia (Kiri), a zelkova (Keyaki), a maple (Kaede), a mulberry (Kuwa), a camphor tree (Kusunoki), a Japanese oak (Nara), an elm (Nire), and bamboo. Alternatively, materials obtained by mixing multiple kinds of crushed lumber or the like may be used.

When a housing of an electronic device is produced, in order to secure processing accuracy and uniformity, it is preferable that an average grain size of wood powder is in a range of 5 μm to 100 μm, as described above. However, depending on the purposes of use, the average grain size may be out of the range.

Figure 2A:
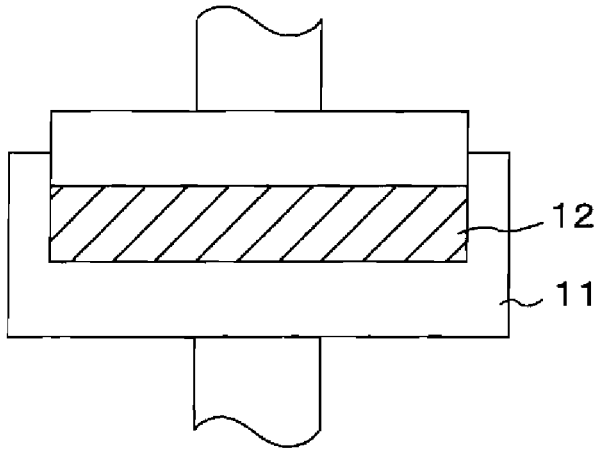
FIGS. 2A to 2D are schematic views depicting, in the order of steps, the method for manufacturing the compression-molded product according to the first embodiment.

Next, as depicted in FIG. 2A, wood powder is filled into a first mold 11, and a first pressure molding step is carried out with a mold temperature of, for example, 100° C. to 250° C. and with a pressure of, for example, 30 MPa to 300 MPa (Step S12). The first pressure molding step is a step for temporary molding in which grains of wood powder are loosely bonded with each other, and is carried out under temperature and pressure conditions where a shape of the bonded grains can be maintained as a molded body. If the temperature and pressure conditions are set too high in the first pressure molding step, a problem arises in that the molded body cannot be impregnated with a flame retardant in the next flame retardant impregnation step. Hereinafter, the molded body molded in the first pressure molding step is referred to as a temporary molded body 12.

Figure 2B:
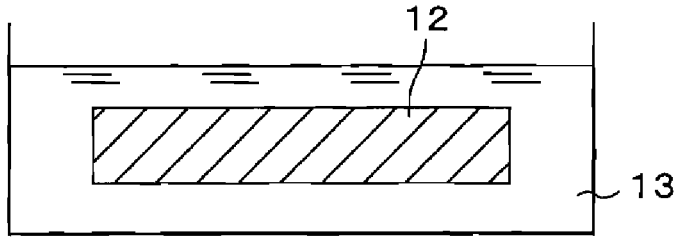

Subsequently, the temporary molded body 12 is taken out of the first mold 11, and a surface of the temporary molded body 12 is impregnated with a flame retardant (Step S13). In the flame retardant impregnation step, the temporary molded body 12 is immersed in a liquid-state flame retardant 13, for example, as depicted in FIG. 2B. Alternatively, a surface of the temporary molded body 12 may be impregnated with the flame retardant by heating the flame retardant, and then bringing a steam of the heated flame retardant into contact with the temporary molded body 12. The flame retardant is impregnated lightly in such a manner that the concentration of the flame retardant is the highest near the surface of the temporary molded body 12. In other words, the flame retardant may not be infiltrated into the core of the temporary molded body 12.

As the flame retardant, a boron-based solution can be used, for example. As a boron-based flame retardant, there is known, for example, sodium polyborate (a borate ion polymer) and zinc borate or the like. Other than the boron-based flame retardant, there is known an organic-based flame retardant such as a phosphoric acid ester and a triazine compound. As the phosphoric acid ester, there can be used, for example, triphenyl phosphate, tricresyl phosphate, trixylenyl phosphate, ammonium polyphosphate and the like. In addition, as the triazine compound, there can be used, for example, melamine cyanurate, tris-isocyanurate and the like.

Figure 2C:
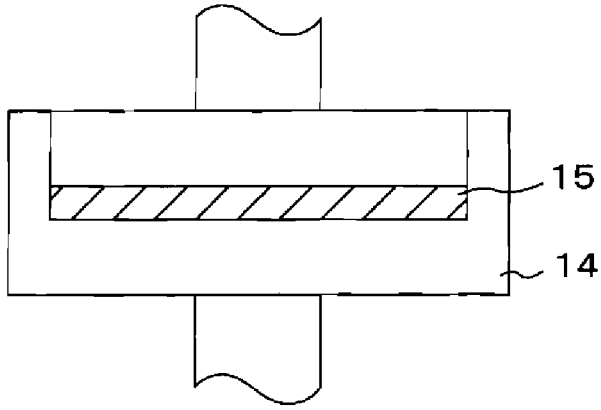

Thereafter, as depicted in FIG. 2C, the temporary molded body 12 having a surface impregnated with the flame retardant is arranged in a second mold 14, and then the second pressure molding step is carried out with a condition higher than that in the first pressure molding step. A mold temperature in the second pressure molding step is, for example, 160° C. to 250° C. and a molding pressure therein is, for example, 50 Pa to 500 Pa (Step S14).

In the second pressure molding step, ingredients such as lignin and a hemicellulose are separated, in a softened state, from wood powder constituting the temporary molded body 12. Then, the ingredients function as a natural adhesive (a binder), and grains of the wood powder in the second mold 14 are firmly bonded with each other so as to be integrated into a single body. Thus, a compression-molded product 15 with a predetermined shape is obtained. The mold temperature and the molding pressure in the second pressure molding step may be appropriately determined depending on the purpose or kind of lumber or the like to be used as a raw material, but it is preferable to set a temperature and a pressure in such a manner that ingredients functioning as an adhesive are separated from wood powder and grains of the wood powder in the mold are integrated into a single body as described above.

Figure 2D:
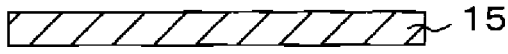

Subsequently, as depicted in FIG. 2D, the compression-molded product 15 is taken out of the second mold 14. The compression-molded product 15 thus manufactured is high in mechanical strength and excellent in dimensional accuracy. In addition, the specific gravity of the compression-molded product 15 can be made 1 or less. Moreover, since only the plant is used as a raw material, the load on the environment is small. Furthermore, because of including the flame retardant, the compression-molded product 15 has characteristics of being difficult to burn.

Note that, in order to further improve the rigidity of the compression-molded product 15, inorganic materials such as a carbon fiber, a glass fiber or a silicate such as a glass frame, a glass bead, talc or mica may be added to the wood powder serving as a raw material. In stead of the inorganic materials, plant-based fibers such as a kenaf or a Manila hemp may be added to the wood powder serving as a raw material. In addition, as needed, a plasticizer, a weather resistance improver, an antioxidant, a heat stabilizer, a light stabilizer, an ultraviolet absorbent, a lubricant, a mold release agent, a pigment, a colorant, an antistatic agent, an aroma chemical, a foaming agent, an antibacterial agent, an antifungal agent or the like may be added to the wood powder serving as a raw material. When the additives are selected, it is preferable that additives with little load on the environment are selected such as the ones harmless to the organism and generating no toxic gas when burned.

Moreover, as needed, the wood powder serving as a raw material may be mixed with petroleum-based resins and the like. In that case, in consideration of the load on the environment, the percentage of the plant-based material may be 25% or more, and more preferably 50% or more.

Figure 3:
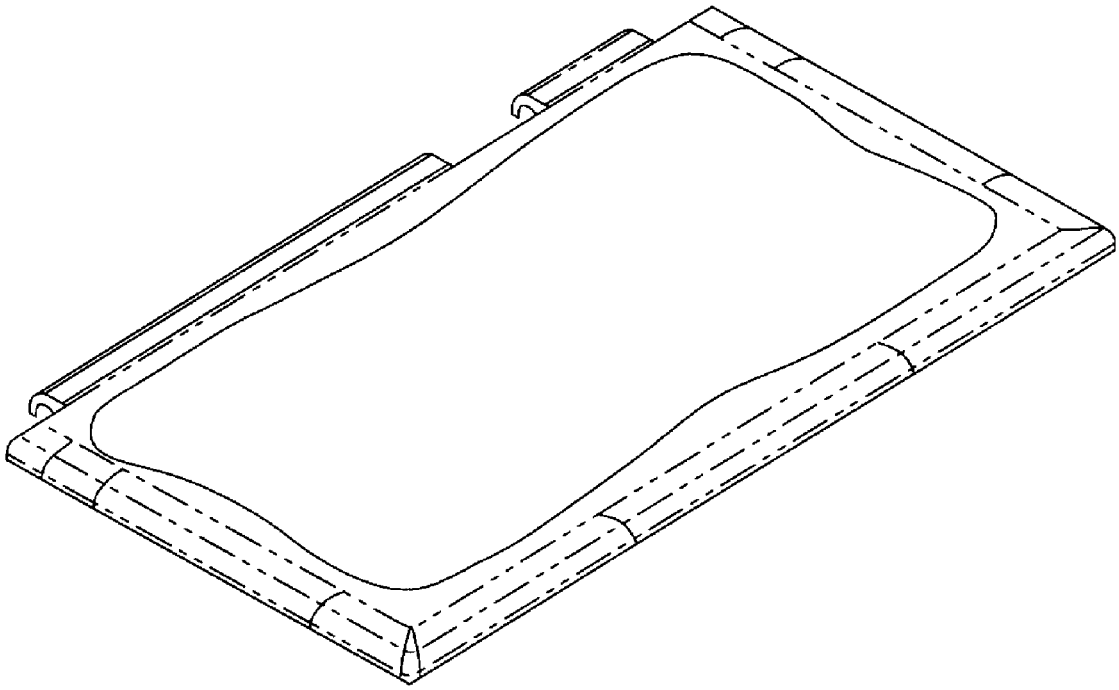
FIG. 3 is a perspective view depicting an example in which the compression-molded product according to the first embodiment is employed as a housing component (a lid portion) of a notebook personal computer.
Figure 4:
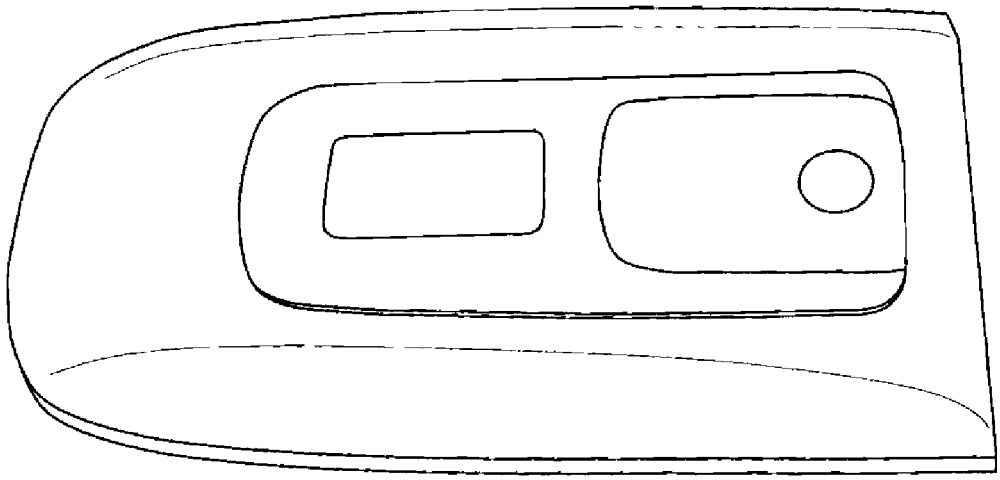
FIG. 4 is a view depicting an example in which the compression-molded product according to the first embodiment is employed as a housing component of a mobile phone.

According to this embodiment, wood scraps generated during lumber processing, abundantly growing bamboo and the like can be effectively utilized. In addition, according to this embodiment, the compression-molded product can be manufactured by only the plant material or by only the plant material and a small amount of the additives. Thus, it is possible to retain the texture of wood in the compression-molded product and to allow the specific gravity to be 1 or less. Moreover, the compression-molded product produced according to this embodiment is high in mechanical strength, excellent in dimensional accuracy and light in weight while having flame retardancy, and is therefore suitable for a housing of an electronic device such as a notebook personal computer and a mobile phone. FIG. 3 depicts an example in which the compression-molded product according to this embodiment is employed as a housing component (a lid portion) of a notebook personal computer. In addition, FIG. 4 depicts an example in which the compression-molded product according to this embodiment is employed as a housing component of a mobile phone.

The compression-molded product is actually manufactured according to a method of this embodiment, and the characteristics of the compression-molded product are investigated. Hereinafter, the result of the investigation will be described.

(Production of Specimen)

First, according to the above-mentioned method, there was produced a bending specimen as defined in the industrial standard of American Society for Testing and Material (ASTM). Namely, as a raw material, wood powder with an average grain size of about 10 μm was obtained by crushing Akita cedar. The wood powder was filled in the first mold, and then the first pressure molding step was carried out by using a heat press machine manufactured by Sansho Industry Co., Ltd., under the conditions that: the molding temperature was 160° C.; the molding pressure was 30 MPa; and the press time was 3 minutes. Thus, the temporary molded body was obtained.

Next, the temporary molded body was taken out of the first mold, and was then immersed in a sodium polyborate solution (a flame retardant) for 10 minutes, so that a surface of the temporary molded body was impregnated with the flame retardant. After that, the temporary molded body was put in a drying oven so as to be dried up.

Subsequently, the temporary molded body was put in the second mold, and then the second pressure molding step was carried out by using the heat press machine manufactured by Sansho Industry Co., Ltd., under the conditions that: the molding temperature was 200° C.; the molding pressure was 100 MPa; and the press time was 3 minutes. Thus, there was obtained an ASTM bending specimen (a compression-molded product) with a size of 12.7 mm×64 mm×3.2 mm.

(Measurement of Bending Strength)

Thereafter, bending strength was measured by using the above bending specimen. Namely, by using a universal testing machine (INSTRON5581) manufactured by Instron Corporation, bending elastic modulus of the specimen was measured in accordance with Japanese Industrial Standards (JIS K 7203) except for the size of the specimen. Note that, 5 bending specimens were produced, and bending elastic modulus of each of the specimens was measured. After that, in accordance with the standard of the measurement of the bending elastic modulus, the maximum and minimum values were removed to calculate the average value, and the average value thus calculated was employed as the bending elastic modulus.

As a result, the bending elastic modulus of the specimen produced according to the first embodiment was 6 GPa. In general, it is preferable that a housing material of an electronic device has 3 GPa to 6 GPa in bending elastic modulus, and it was confirmed from the above test that the compression-molded product produced according to the first embodiment had the preferable bending elastic modulus for a housing of an electronic device.

(Measurement of Flame Retardancy)

Subsequently, on the basis of the flame retardancy test as defined in the UL94 standard, the flame retardancy of the above specimen produced according to the first embodiment was investigated. Namely, a specimen was perpendicularly supported, and a lower end of the specimen was brought into contact with a flame of a gas burner and is kept for 10 seconds. After that, the flame of the gas burner was taken away from the specimen. Then, when the flame was extinguished, the specimen was immediately brought into contact with the flame of the burner for 10 seconds.

In the UL94 standard, flaming combustion duration times after first and second flame contacts, the total of flaming combustion duration time and non-flaming combustion duration time after the second flame contact, the total of flaming combustion duration time of the 5 specimens, and the presence or absence of a flame dripping material (a drip) were investigated so as to determine classes (V-0, V-1, and V-2) on the basis of the result of the investigation.

The class V-0 requires that: each of the flaming combustion times after the first and the second flame contacts is within 10 seconds; the total of flaming combustion duration time and non-flaming combustion time after the second flame contact is within 30 seconds; the total of the flaming combustion time of 5 specimens is within 50 seconds; and no flame dropping material exists.

In addition, the class V-1 requires that: each of the flaming combustion times after the first and the second flame contacts is within 30 seconds; the total of flaming combustion duration time and non-flaming combustion time after the second flame contact is within 60 seconds; the total of the flaming combustion time of 5 specimens is within 250 seconds; and no flame dripping material exists.

Moreover, the class V-2 requires that: each of the flaming combustion times after the first and the second flame contacts is within 30 seconds; the total of flaming combustion duration time and non-flaming combustion time after the second flame contact is within 60 seconds; and the total of the flaming combustion time of 5 specimens is within 250 seconds. In the class V-2, a flame dripping material is allowed to exist. Note that, if the specimen is completely burned out, neither of the class V-0, V-1, or V-2 is applicable.

As a result of carrying out the flame retardancy test of the UL94 standard, it was confirmed that the specimen produced according to the first embodiment had the flame retardancy equivalent to the class V-0, since the specimen, even though brought into contact with the flame of the gas burner, underwent immediate extinction of the flame once the gas burner was taken away therefrom, and did not generate any flame dripping material.

(Second Embodiment)

Figure 5:
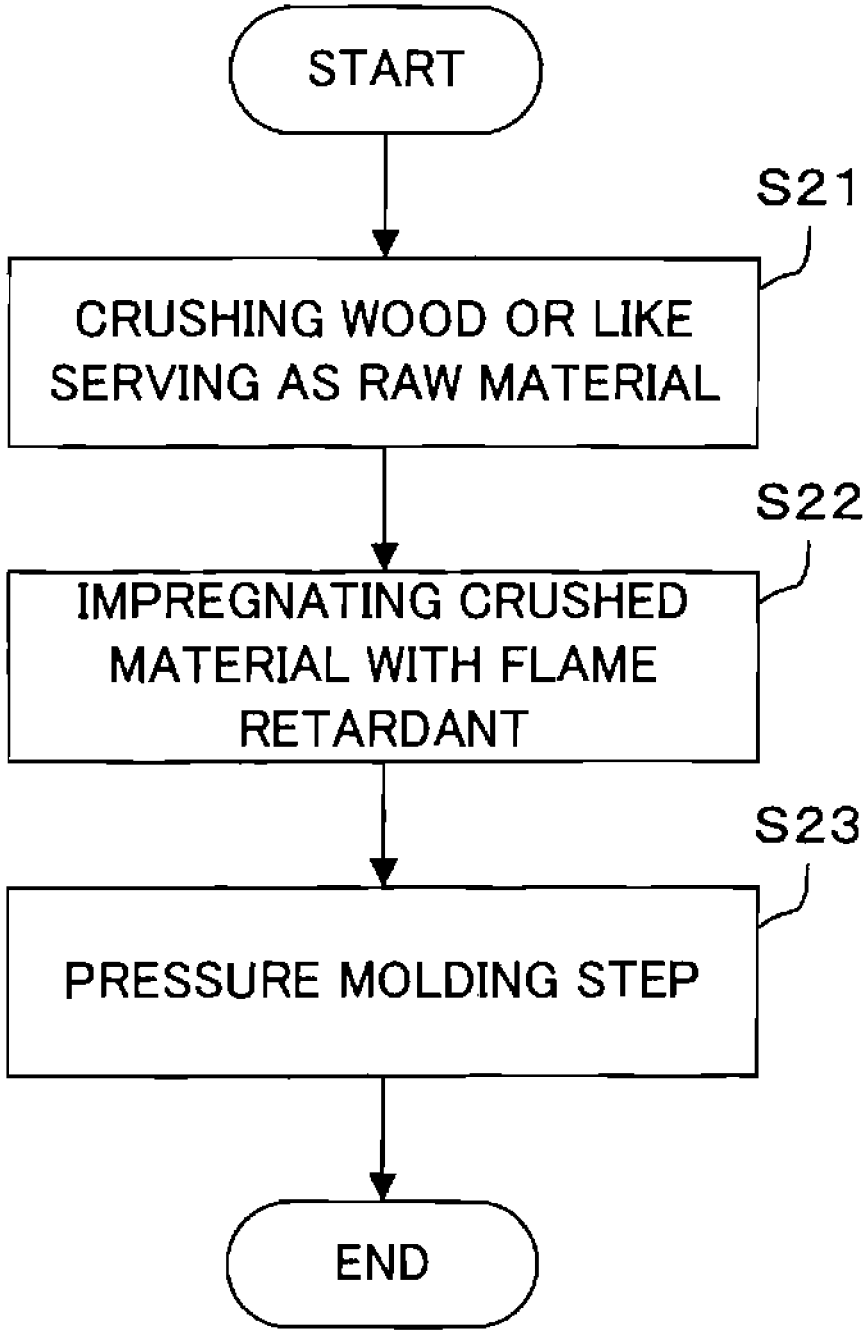
FIG. 5 is a flowchart depicting a method for manufacturing a compression-molded product according to a second embodiment.

FIG. 5 is a flowchart depicting a method for manufacturing a compression-molded product according to a second embodiment.

First, wood or bamboo serving as a raw material is crushed to obtain a crushed material with an average grain size of about 500 μm (Step S21).

Next, a surface of the crushed material is impregnated with a flame retardant (Step S22). For example, the crushed material is immersed in a boron-based flame retardant solution, and thus the surface of the crushed material is impregnated with a flame retardant. In this case, it is sufficient to lightly impregnate the surface of the crushed material with the flame retardant, and to immerse the crushed material in the flame retardant for only a short period of time.

Subsequently, the crushed material thus impregnated with the flame retardant is put in a mold, and a pressure molding step is carried out (Step S23). In the pressure molding step, a mold temperature is, for example, 160° C. to 250° C., while a molding pressure is, for example, 50 Pa to 500 Pa. In the pressure molding step, plant-derived ingredients such as lignin and a hemicellulose are separated, in a softened state, from a crushed material of wood or bamboo. Then, the ingredients function as an adhesive, and pieces of the crushed material in the mold are integrated into a single body. Thus, a compression-molded product with a predetermined shape is obtained. After that, the compression-molded product is taken out of the mold. In this way, the compression-molded product is completed.

Note that, although a crushed material of wood or bamboo is used as a raw material in this embodiment, a carbon fiber, a glass fiber, a plant fiber, a plasticizer, a weather resistance improver, an antioxidant, a heat stabilizer, a light stabilizer, an ultraviolet absorbent, a lubricant, a mold release agent, a pigment, a colorant, an antistatic agent, an aroma chemical, a foaming agent, an antibacterial agent, an antifungal agent or the like may be added to the crushed material of the wood or bamboo so as to form a raw material.

The compression-molded product manufactured according to this embodiment uses only the plant or only the plant and a small amount of the additives, and thus the load on the environment is small. In addition, the compression-molded product manufactured according to this embodiment includes the flame retardant, and thus has the characteristics of being difficult to burn.

Note that, a description is given of the case where the crushed plant material is put in a mold and pressurizing molding is performed to manufacture the compression-molded product in the first and the second embodiments, but the embodiments are not limited thereto. By using wood chips cut or shaved into a shape similar to a desired shape, plant-derived adhesive ingredients such as lignin and a hemicellulose may be separated by compressing on heating the wood chips so as to manufacture the compression-molded product as a product. In this case, plant fibers are firmly bonded with each other by the plant-derived adhesive ingredients, and thus the compression-molded product with high strength can be obtained. In addition, petroleum-based resins and the like are not required, and thus the load on the environment is small.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A method for manufacturing a compression-molded product, comprising:

forming a temporary molded body by pressurizing a crushed plant material as a first pressure molding;

impregnating a surface of the temporary molded body with a flame retardant; and separating an adhesive ingredient derived from the crushed plant material by pressuring on heating the temporary molded body as a second pressure molding.

2. The method for manufacturing a compression-molded product according to claim 1, wherein the crushed plant material is a material obtained by crushing wood or bamboo.

3. The method for manufacturing a compression-molded product according to claim 1, wherein a temperature in the second pressure molding is from 160° C. to 250° C., both inclusive.

4. The method for manufacturing a compression-molded product according to claim 1, wherein a heating temperature in the second pressure molding is higher than that in the first pressure molding.

5. The method for manufacturing a compression-molded product according to claim 1, wherein the flame retardant contains a boron-based material or an organic-based material.

* * * * *